US010485320B2

(12) United States Patent
Hsu

(10) Patent No.: US 10,485,320 B2
(45) Date of Patent: Nov. 26, 2019

(54) HAIR DRYER

(71) Applicant: Shih-Ling Hsu, Tainan (TW)

(72) Inventor: Shih-Ling Hsu, Tainan (TW)

( * ) Notice: Subject to any disclaimer, the term of this patent is extended or adjusted under 35 U.S.C. 154(b) by 651 days.

(21) Appl. No.: 15/242,409

(22) Filed: Aug. 19, 2016

(65) Prior Publication Data

US 2018/0049532 A1 Feb. 22, 2018

(51) Int. Cl.
*A45D 20/12* (2006.01)
*F26B 23/06* (2006.01)

(52) U.S. Cl.
CPC ..... *A45D 20/12* (2013.01); *F26B 23/06* (2013.01)

(58) Field of Classification Search
CPC ..... A45D 20/12; A45D 20/10; A45D 20/00; F26B 23/06; F23D 14/36
USPC ..... 34/97, 96
See application file for complete search history.

(56) References Cited

U.S. PATENT DOCUMENTS 3,492,462 A * 1/1970 Schumacher ..... A45D 20/10 392/385
4,260,875 A * 4/1981 Walter ..... A45D 20/30 219/501
4,323,761 A * 4/1982 Hubner ..... A45D 20/10 338/237
4,658,511 A * 4/1987 Mahlich ..... A45D 20/18 34/101
4,924,602 A * 5/1990 Ohlsen ..... A45D 20/12 34/97
5,013,891 A * 5/1991 Shoemaker ..... A45D 20/12 219/383
5,344,314 A * 9/1994 Zagoroff ..... F23D 14/36 432/222
5,448,677 A * 9/1995 Fell ..... A45D 20/10 34/85
5,555,637 A * 9/1996 Montagnino ..... A45D 20/10 34/97
5,701,681 A * 12/1997 Wonka ..... A45D 20/12 34/96
5,810,911 A * 9/1998 Behrendt ..... A45D 20/12 34/97
5,841,943 A * 11/1998 Nosenchuck ..... A45D 20/10 392/385
6,389,710 B1 * 5/2002 Chou ..... A45D 20/12 219/222
7,204,038 B2 * 4/2007 Santhouse ..... A45D 20/12 132/116
2004/0216322 A1 * 11/2004 Collier ..... A45D 20/06 34/97
2005/0229424 A1 * 10/2005 Hur ..... A45D 20/12 34/97
2008/0040943 A1 * 2/2008 Worgull ..... A45D 20/10 34/97

(Continued)

*Primary Examiner* — Kenneth Rinehart
*Assistant Examiner* — Bao D Nguyen

(57) ABSTRACT

An improved hair dryer includes a fan unit and a heating unit to generate a linear heated air current which can mix with outside cold air to obtain a rotational air current of moderate temperature and to increase the capability of penetrating a user's hair. Therefore, the air provided by the hair dryer would not become both hot and dry, but maintain an ideal, moderate temperature suitable for users, so that users may feel more comfortable while dressing their hairs. Furthermore, the increased capability of penetrating a user's hair allows the hair to be dried more quickly.

6 Claims, 6 Drawing Sheets

(56) References Cited

U.S. PATENT DOCUMENTS

2008/0056692 A1* 3/2008 Yeh ..... A45D 20/12 392/407
2009/0000141 A1* 1/2009 Gross ..... A45D 20/12 34/90
2012/0125909 A1* 5/2012 Scheunert ..... A45D 20/12 219/222
2013/0269200 A1* 10/2013 Moloney ..... A45D 20/00 34/97
2013/0269201 A1* 10/2013 Courtney ..... A45D 20/04 34/97
2013/0276321 A1* 10/2013 Courtney ..... A45D 20/00 34/97
2013/0283630 A1* 10/2013 Courtney ..... A45D 20/10 34/97
2013/0283631 A1* 10/2013 Moloney ..... A45D 20/10 34/97
2014/0290087 A1* 10/2014 Weatherly ..... A45D 20/12 34/98
2015/0007442 A1* 1/2015 Gammack ..... A45D 20/08 34/97
2015/0007443 A1* 1/2015 Gammack ..... A45D 20/08 34/97
2015/0007444 A1* 1/2015 Moloney ..... A45D 20/10 34/97
2015/0020401 A1* 1/2015 Atkinson ..... H02K 5/24 34/97
2015/0082652 A1* 3/2015 Atkinson ..... A45D 20/12 34/97
2015/0093099 A1* 4/2015 Shelton ..... A45D 20/12 392/380
2015/0157106 A1* 6/2015 Atkinson ..... A45D 20/00 34/97
2016/0143409 A1* 5/2016 Moloney ..... A45D 20/08 34/97
2016/0166033 A1* 6/2016 Kerr ..... A45D 20/10 34/97
2016/0166035 A1* 6/2016 Douglas ..... A45D 20/12 34/97

* cited by examiner

HAIR DRYER

TECHNICAL FIELD OF THE INVENTION

The present invention relates to an improved hair dryer and, more particularly, to a hair dryer which employs a fan unit and a heating unit to generate a linear heated air current capable of mixing with outside air to obtain a rotational air current of moderate temperature and to increase the capability of penetrating the hair of a user.

DESCRIPTION OF THE PRIOR ART

Hair dryers, which are commonly used at home, have a simple structure. Typically, a hair dryer is provided therein with a fan unit and a heating unit. In use, the fan unit can draw outside air into its housing to generate an air current, which is then heated by the heating unit and finally goes out of the housing via an exit. In conventional hair dryers, a standardized motor unit is usually employed to drive a fan unit within a machine case so as to draw outside air into the machine case via air inlets to form an ongoing air current, and a heating unit is provided in front of the motor unit and the fan unit for heating the ongoing air current. The heating unit can be a conventional resistance heater or a mica heater. Generally, the fan is mounted at the output shaft of the motor to achieve the function of air supply, and can be worked with a heating unit to supply heated air. However, the air current provided by this type of hair dryer tends to be both dry and hot. In combing hair, the ongoing air current can only enter the top of the hair structure of a user, but unable to enter the bottom of the hair structure. Therefore, the top of the hair structure of the user will become dry and hot, while the bottom of the hair structure still remains wet.

SUMMARY OF THE INVENTION

In view of the foregoing, the applicant intends to develop an improved hair dryer for solving the shortcomings of conventional hair dryers.

According to one embodiment of the present invention, the improved hair dryer generally comprises a main body assembled from a front shell and a rear shell, a conical shell, a central tube, a heating unit, a fan unit, and a driving unit, whereby the driving unit can rotate the fan unit to draw outside air into the main body to generate an air current that can be directed to flow along multiple paths, so that the hair dryer can provide more air, which is obtained by uniformly mixing hot air with cold air to obtain a rotational air current of moderate temperature and to increase the capability of penetrating the hair of a user, can reduce noise, and can effectively reduce the temperature in the main body.

Other objects, advantages, and novel features of the present invention will become more apparent from the following detailed description when taken in conjunction with the accompanying drawings

DETAILED DESCRIPTION OF THE PREFERRED EMBODIMENTS

Figure 1:
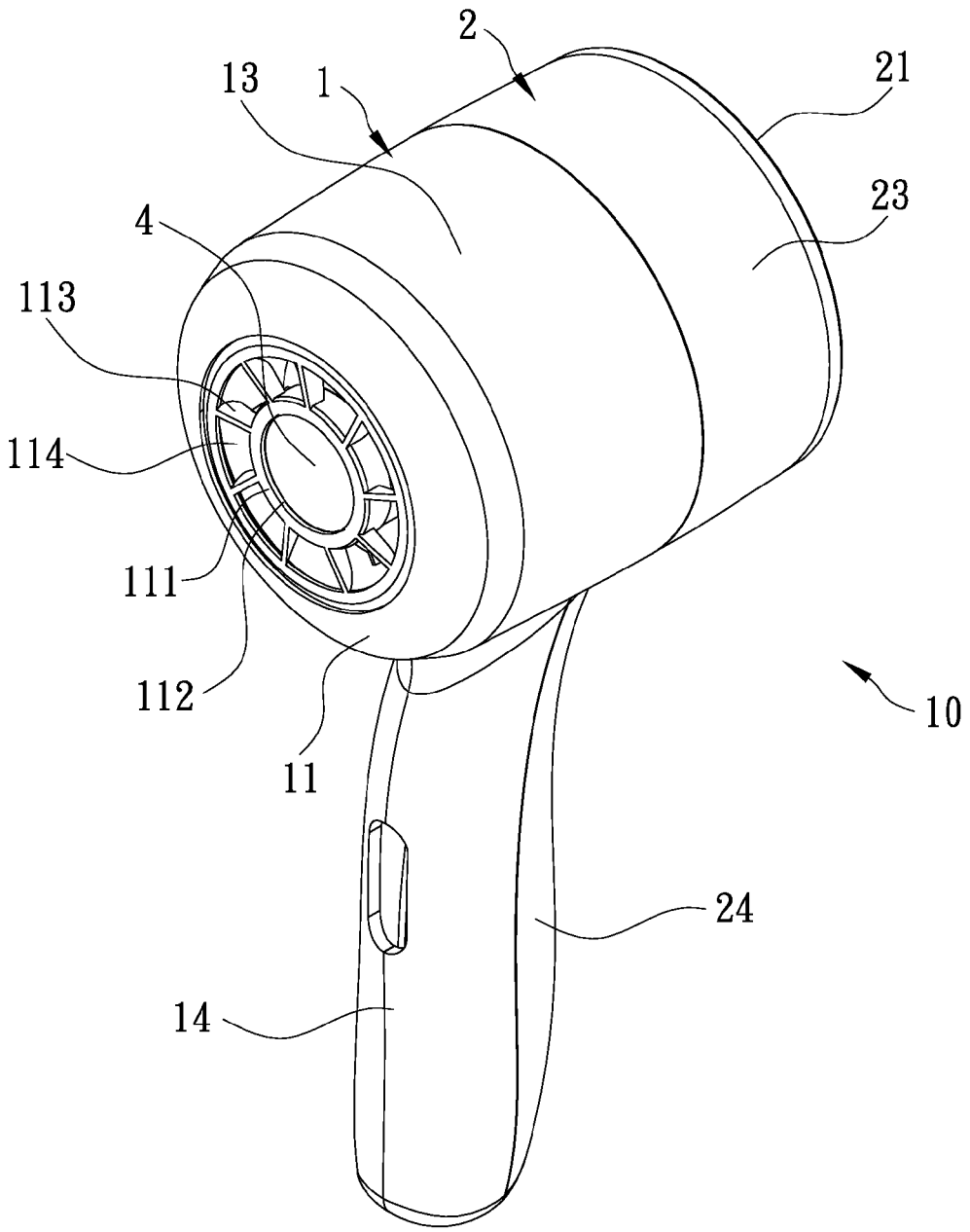
FIG. 1 shows a 3-dimensional view of a hair dryer according to one embodiment of the present invention.

Referring to FIGS. 1 through 5, an improved hair dryer according to one embodiment of the present invention is shown, which comprises a front shell 1 and a rear shell 2, both of which can be assembled to form a hollow main body 10, in which a fan unit 7 and a heating unit 5 is provided. The fan unit 7 can draw outside air (F) into the main body 10 to form therein an air current, which can be heated by the heating unit 5 to form a heated air current that finally flows out of the main body 10.

The front shell 1 has a front wall 11 provided with a central holding ring 111 defining therein a central outlet hole 112. The front wall 11 is formed with a plurality of air-guiding blades 113 around the central holding ring 111, wherein a plurality of peripheral outlet holes 114 are defined between the air-guiding blades 113. Each of the air-guiding blades 113 is configured to have a twisted surface. The first shell 1 has a circumferential wall 13, which is formed integrally with the front wall 11 and terminates at a rear opening 12 opposite to the front wall 11. The circumferential wall 13 is provided at its inner surface with a plurality of ribs 131 extending substantially from the front wall 11 to the rear opening 12. Furthermore, the first shell 1 is formed integrally with a part 14 that extends downwardly from the circumferential wall 13 to serve as a front half of a handle.

The rear shell 2 has a rear wall 21 and a circumferential wall 23 formed integrally with the rear wall 21 and terminating at a front opening 22 opposite to the rear wall 21. The rear wall 21 is provided with an inner tube 211 that defines a central inlet hole 212 at a first end and extends from the first end to a second end in the direction of the front opening 22 with a gradually reduced diameter, and thus the inner tube 211 appears as a funnel-shaped tube. Furthermore, the rear wall 21 defines a plurality of peripheral air inlets 213 around the inner tube 211. The rear wall 21 is provided at its inner surface with a plurality of ribs 214 extending substantially from the inner tube 211 to the circumferential wall 23. Furthermore, the rear shell 2 is formed integrally with a part 24 that extends downwardly from the circumferential wall 23 to serve as a rear half of the handle.

Figure 6:
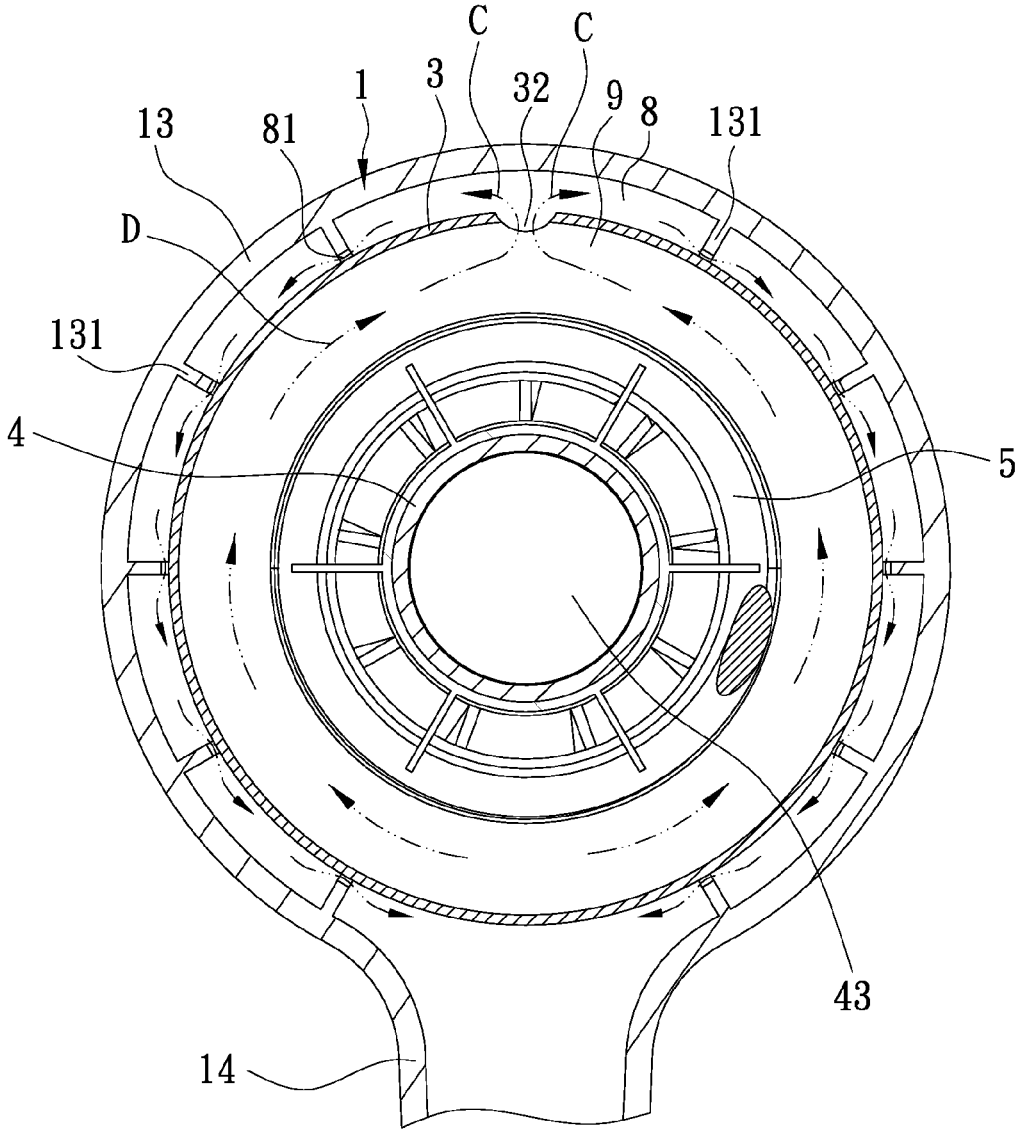

A conical shell 3, with a large open end and a small open end opposite to the large open end, is provided with a flange 31 which extends outwardly from a circumferential edge of the large open end, and defines a notch 32 that cuts the flange 31 and extends in the direction of the small open end. The conical shell 3 is located in the front shell 1, wherein an assistant member 33 can be used to fix the conical shell 3 to the main body 10. The flange 31 of the conical shell 3 abuts one end of each of the ribs 131 close to the rear opening 12, and the assistance member 33 is placed in contact with the flange 31 of the front shell 3, at a location near the notch 32, and attached to an inner surface of the circumferential wall 23 of the rear shell 2. There is a space 8 existing between the circumferential wall 13 of the front shell 1 and the conical shell 3 to serve as an insulating zone, wherein a gap 81 exists between each of the ribs 131 and the conical shell 3 (see FIGS. 3 and 6).

A central tube 4 is located in the conical shell 3. The central tube 4 has a first end 41 and a second end 42, and defines therein a channel 43, wherein the first end 41 is fitted into the central holding ring 111 of the front shell 1.

A heating unit 5 is located in the conical shell 3 and fitted around the central tube 4. The heating unit 5 can be a mica heater or a resistance heater. There is a space 9 existing between the heating unit 5 and the conical space 3 to serve as a heating zone.

A driving unit 6, which is mounted around the central tube 4, includes a first element 61, a second element 62, and a bearing 63. The first element 61, which is an annular electromagnetic coil, and the bearing 63 are mounted immediately around the central tube 4. The second element 62 is an annular magnet The fan unit 7, which is briefly described above, has a central hub defining a central hole 70 for mounting over the driving unit 6. The fan unit 7 is provided at one end of the central hub with a retaining edge 71, which extends inwardly of the central hole 70, and is provided with a plurality of blades 72 extending outwardly from the central hub. The driving unit 6 is mounted within the central hole 70 of the fan unit 7, around the central tube 4. The first element 61 is fixedly mounted around the central tube 4, while the second element 62 is rotatably mounted around the first element 61 and fixed to an inner surface of the central hole 70 of the fan unit 7, wherein a gap 64 exists between the first element 61 and the second element 62 (see FIG. 5). The bearing 63 is mounted in the central hole 70, between the central tube 4 and the fan unit 7, and limited by the retaining edge 71. The first element 61 can drive the second element 62 together with the fan unit 7 to rotate about the bearing 63.

Figure 2:
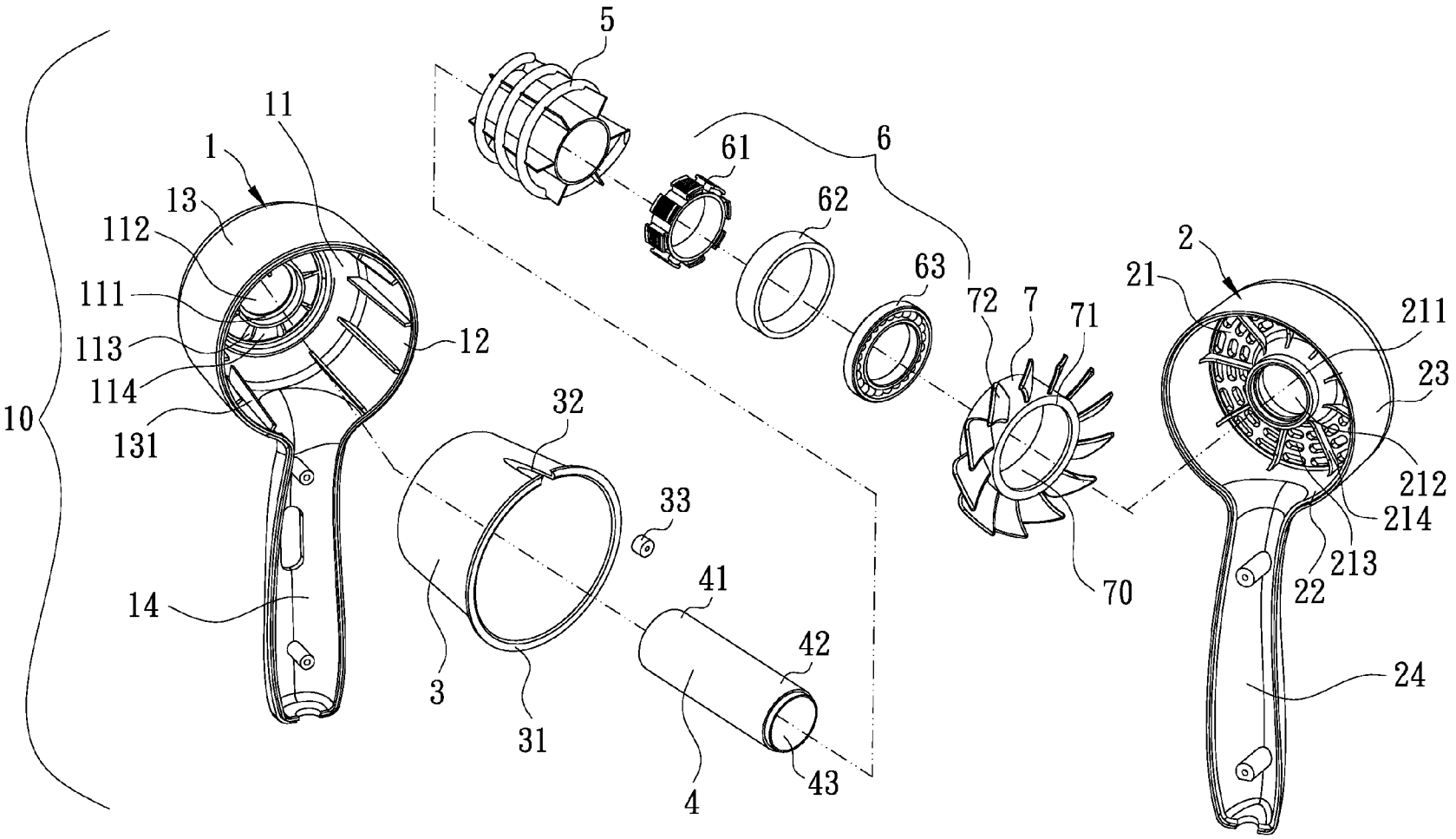
FIG. 2 shows an exploded view of the hair dryer.
Figure 3:
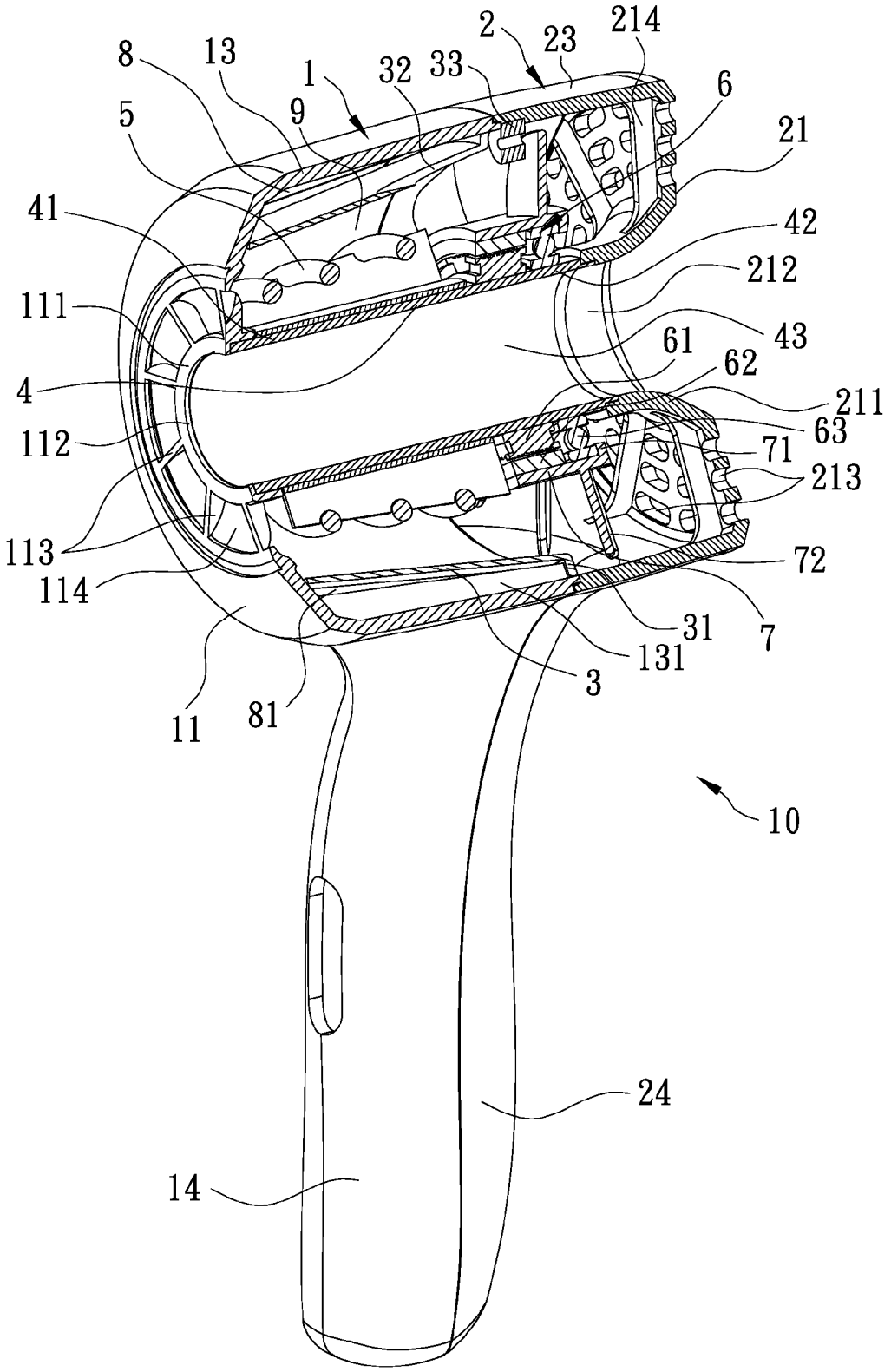
FIG. 3 shows a 3-dimensional sectional view of the hair dryer.
Figure 4:
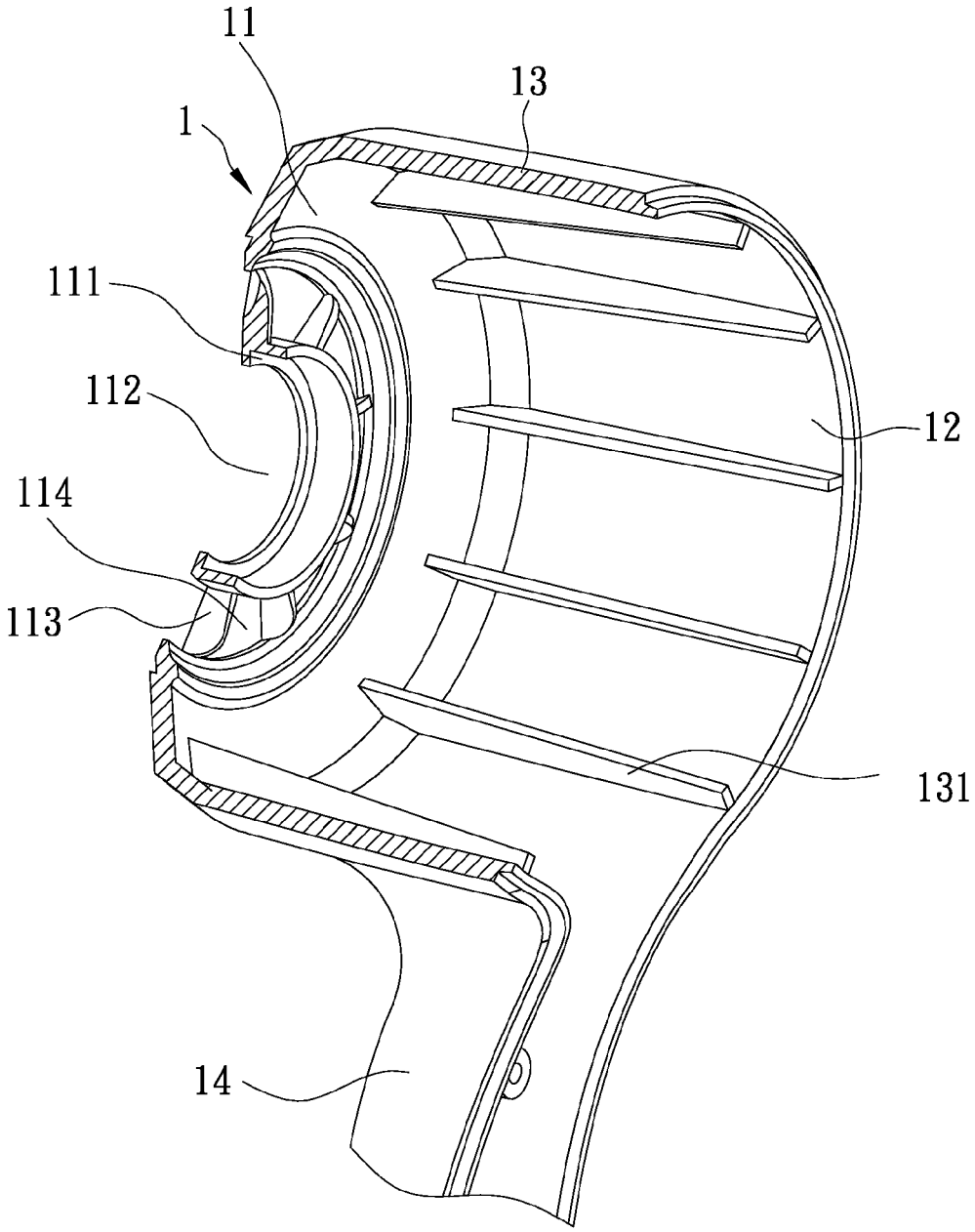
FIG. 4 shows a 3-dimensional sectional view of a front shell used in the hair dryer.
Figure 5:
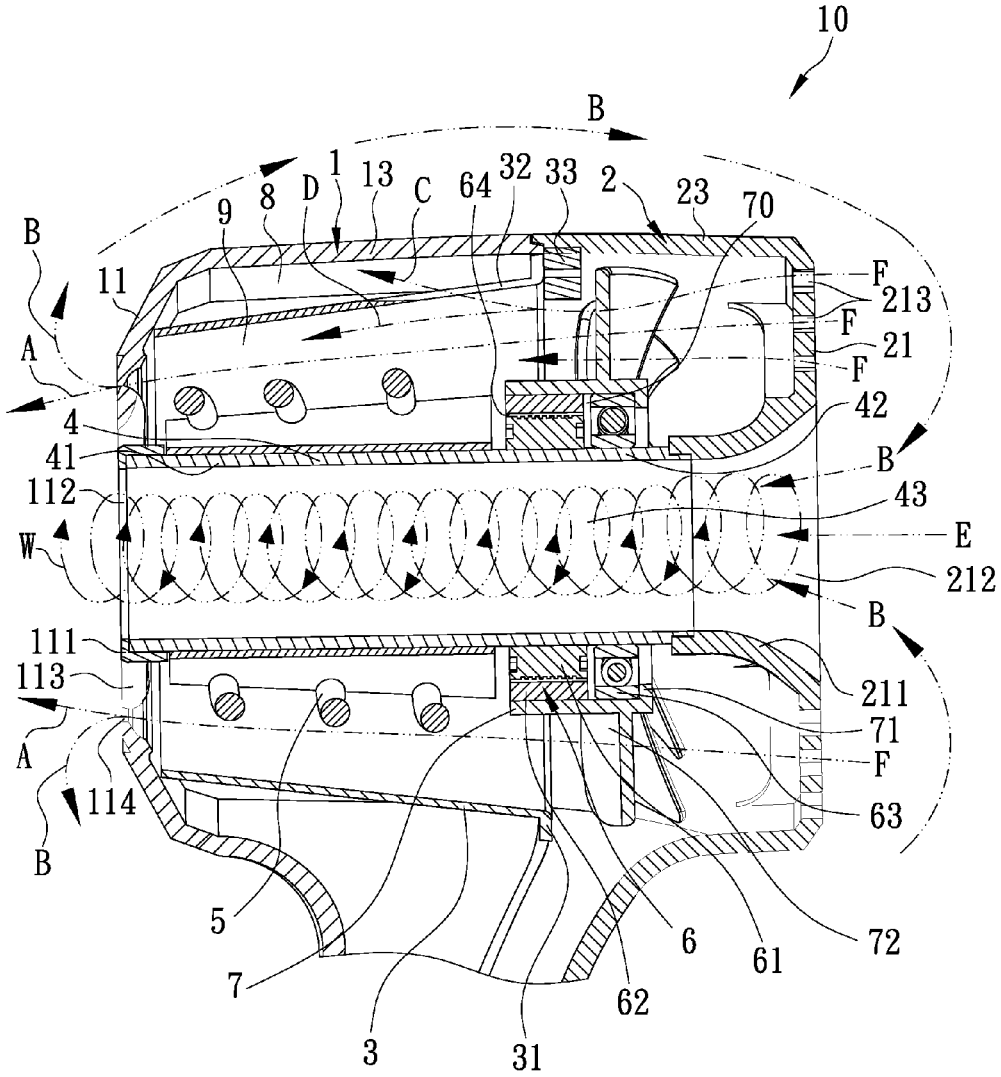
FIGS. 5 and 6 show sectional views of the hair dryer, wherein various paths for the air current are revealed.

In assembling the foregoing parts, the conical shell 3, the central tube 4, the heating unit 5, the driving unit 6, and the fan unit 7 are placed in the front shell 1 via the rear opening 12, and then the rear shell 2 is assembled to the front shell 1 by joining the rear opening 12 of the first shell 1 with the front opening 22 of the rear shell 2, wherein the second end 42 of the central tube 4 is fitted into the inner tube 211 (see FIGS. 2 and 3). In operation, as shown in FIG. 5, the driving unit 6 can rotate the fan unit 7 to draw outside air (F) into the main body 10 to form an air current, which then can be directed to flow along multiple paths, so that the hair dryer can provide more air, which is obtained by uniformly mixing hot air with cold air to obtain a rotational air current of moderate temperature and to increase the capability of penetrating the hair of a user, can reduce noise, and can effectively reduce the temperature in the main body 10. Since the air provided by the hair dryer of the present invention is a rotational, ongoing air current rather than a linear, ongoing air current, the air can enter not only the top of the hair structure of a user, but also the bottom of the hair structure, so that wet hair can be dried more quickly. In addition, the hair dryer can mix a heated air current with outside cold air to form a rotational air current, which finally flows out of the central inlet hole 112 and has a moderate temperature suitable for a user, as will be fully described below.

Referring to FIG. 5, the fan unit 7 can draw outside air (F) to enter the main body 10 via the peripheral inlet holes 213 of the rear shell 2, wherein one portion of the air entering the conical shell 3 can flow into the insulating zone 8 between the circumferential wall 13 of the front shell 1 and the conical shell 3 via the notch 32 to form an air current (C) that can flow through the gaps 81 between the ribs 131 of the front shell 1 and the conical shell 3 (see FIG. 6) to dissipate the heat generated in the main body 10. Another portion of the air entering the conical shell 3 can flow through the heating zone 9 and can be heated by the heating unit 5 to form a linear heated air current (D), which can flow out of the conical shell 3 via the peripheral outlet holes 114 between the air-guiding blades 113. The twisted surfaces of the air-guiding blades 113 can covert the linear heated air current (D) into a substantially straight air stream (A) and a curved air stream (B) (see HG 5) which can flow back to the central inlet hole 212, mixing with the outside cold air (E), and enter the channel 43 of the central tube 4 to become a rotational air current (W), which finally flows out of the central tube 4 via the central outlet hole 112. Due to the rotational air current (W) mixing with outside cold air, the air current (W) has a moderate temperature, and this allows users to feel more comfortable while dressing their hairs. Furthermore, since the hair dryer of the present invention provides multiple paths for the air current generated in the main body 10, the hair penetration capability of the hair dryer can be increased, and thus a user's hair can be dressed and dried more easily.

As a summary, the hair dryer of the present invention provides multiple paths for the air current generated in the main body 10, so that it can provide more air, which is obtained by uniformly mixing hot air with cold air, can reduce noise, can increase the capability of penetrating a user's hair, and effectively reduce the temperature in the main body 10. Among the multiple paths, the heated air current (B) can mix with the outside cold air (E) to form a rotational air current (W), which can penetrate a user's hair more easily so that the hair can be dried more quickly. In addition, the air current (W) provided by the present invention will not become both hot and dry, but maintain an ideal, moderate temperature suitable for a user, so that users may feel more comfortable while dressing their hairs.

Although the present invention has been described with a certain degree of particularity, it is understood that the present disclosure is made by way of example only and the combination and arrangement of parts may be resorted to without departing from the spirit and scope of the invention hereinafter claimed.

I claim:

1. An improved hair dryer, comprising:

a front shell having a front wall and a circumferential wall which is formed integrally with the front wall and terminates at a rear opening opposite to the front wall, the front wall being provided with a central holding ring defining therein a central outlet hole, the front wall being further provided with a plurality of air-guiding blades around the central holding ring and defining a plurality of peripheral inlet holes between the air-guiding blades;

a conical shell with a large open end and a small open end opposite to the large open end, the conical shell being provided with a flange, which extends outwardly from a circumferential edge of the large open end, and defining a notch, which cuts the flange and extends in the direction of the small open end, the conical shell being located in the front shell;

a central tube having a first end and a second end and defining therein a channel, the central tube being located in the conical shell, wherein the first end is fitted into the central holding ring of the front shell;

a heating unit located in the conical shell and fitted around the central tube;

a driving unit fitted around the central tube and including a first element, a second element, and a bearing;

a fan, which has a central hub defining therein a central hole and provided at one end with a retaining edge extending inwardly of the central hole and provided with a plurality of blades extending outwardly from the central hub, the driving unit being mounted in the central hole of the fan, wherein the first element is fixedly mounted around the central tube, the second element is rotatably mounted around the first element and fixed to the fan, and the bearing is mounted in the central hole of the fan, between the central tube and the fan, and limited by the retaining edge of the fan, the first element capable of driving the second element together with the fan to rotate about the bearing; and a rear shell having a rear wall and a circumferential wall which is formed integrally with the rear wall and terminates at a front opening opposite to the rear wall, the rear wall being provided with an inner tube that defines a central inlet hole at a first end and extends from the first end to a second end in the direction of the front opening with a gradually reduced diameter, the rear shell defining a plurality of peripheral inlet holes around the inner tube, the rear shell being assembled to the front shell by joining the rear opening of the front shell with the front opening of the rear shell to form a hollow main body for accommodating the foregoing elements, wherein the second end of the central tube is fitted into the inner tube;

whereby the driving unit can rotate the fan to draw outside air into the main body to generate an air current that can be directed to flow along multiple paths, so that the hair dryer can provide more air, which is obtained by mixing hot air with cold air to obtain a rotational air current of moderate temperature and to increase a capability of penetrating hairs of a user, can reduce noise, and can effectively reduce the temperature in the main body.

2. The improved hair dryer of claim 1, wherein each of the air-guiding blades provided at the front shell has a twisted surface for converting the air current into a straight air stream and a curved air stream capable of flowing back and entering the main body.

3. The improved hair dryer of claim 1, wherein the front shell is provided at an inner surface of the circumferential wall thereof with a plurality of ribs extending from the front wall to the rear opening, and is formed with a part extending downwardly from the circumferential wall thereof to serve as a front half of a handle.

4. The improved hair dryer of claim 3, wherein the flange of the conical shell abuts one end of each of the ribs close to the rear opening of the front shell, and the conical shell is fixed by an assistance member which is in contact with the flange of the front shell and is attached to an inner surface of the circumferential wall of the rear shell, wherein a space exists between the circumferential wall of the front shell and the conical shell to serve as an insulating zone, and a gap exists between each of the ribs and the conical shell.

5. The improved hair dryer of claim 1, wherein the rear shell is provided at an inner surface of the circumferential wall thereof with a plurality of ribs extending from the inner tube to the circumferential wall thereof, and is formed with a part extending downwardly from the circumferential wall thereof to serve as a rear half of a handle.

6. The improved hair dryer of claim 1, wherein the heating unit is a mica heater or a resistance heater, and a space exists between the conical shell and the heating unit to serve as a heating zone.

* * * * *